United States Patent [19]

Heitzman

[11] 4,421,466

[45] Dec. 20, 1983

[54] APPARATUS FOR MOLDING CONCRETE ARTICLES AND THE LIKE

[75] Inventor: Charles J. Heitzman, Honolulu, Hi.

[73] Assignee: Auto-Cast International, Ltd., Honolulu, Hi.

[21] Appl. No.: 278,173

[22] Filed: Jun. 29, 1981

[51] Int. Cl.[3] ..... B28B 21/90

[52] U.S. Cl. ..... 425/125; 425/126 R; 425/253; 425/452

[58] Field of Search ..... 425/117, 125, 126 R, 425/253, 431, 452, 441

[56] References Cited

U.S. PATENT DOCUMENTS

| | | | |
|---|---|---|---|
| 3,303,545 | 2/1967 | Heitzman | 425/441 |
| 3,611,518 | 10/1971 | Glass | 425/452 |
| 3,624,825 | 0/1971 | Heitzman . | |
| 4,068,996 | 1/1978 | Heitzman | 425/452 |

*Primary Examiner*—John A. Parrish
*Attorney, Agent, or Firm*—Jacox & Meckstroth

[57] ABSTRACT

An elongated mold box encloses a removable rectangular pallet and has a center portion pivotally supported by a carriage which is supported for vertical movement by a pair of vertical guide posts mounted on a frame. Hydraulic cylinders are connected to move the carriage vertically relative to the frame and pivot the mold box relative to the carriage for tilting the mold box between a vertical concrete filling position and a horizontal position for stripping a molded concrete article from the mold box. The pallet is supported within the mold box by a generally flat tray member which is guided by parallel rails within the mold box and aligned horizontal guide rails on a run-out platform. The mold box also carries a hydraulic cylinder for moving the tray member between a retracted position within the mold box and an extended position on the run-out platform.

21 Claims, 7 Drawing Figures

APPARATUS FOR MOLDING CONCRETE ARTICLES AND THE LIKE

BACKGROUND OF THE INVENTION

This invention relates to apparatus for molding a self-hardening material such as concrete and for efficiently producing molded concrete articles or the like. In general, such apparatus is disclosed in U.S. Pat. Nos. 3,303,545, 3,624,825 and 4,068,996 which issued to applicant. In such molding apparatus, an elongated mold box is supported for tilting movement between a vertical concrete filling position and a horizontal article stripping position. When the mold box is in the vertical position, mixed concrete is delivered from a hopper to the top open end of the mold box which contains a pallet. The concrete is conveyed into the mold box while the mold box is vibrated and until the mold box is filled. The mold box is then tilted to a horizontal position where the molded concrete article is supported by the pallet within the mold box and where the concrete article is stripped from the mold box onto a horizontal run-out table or platform while the article continues to be supported by the pallet.

In the construction of the above equipment or apparatus for molding large rectangular concrete panels or slabs, it is desirable to avoid the construction of a pit within the ground or floor for receiving the mold box when it is tilted to a vertical filling position, for example, as disclosed in above U.S. Pat. No. 3,624,825. As disclosed in above U.S. Pat. No. 4,068,996, the construction of a pit may be avoided by pivotally supporting the mold box at one end. However, when the mold box is relatively large and the mold box cavity is filled with concrete, substantially large hydraulic cylinders are required to pivot the mold box, and substantial stresses are encountered in the cantileverly supported mold box.

In the construction of the molding apparatus shown in the above patents, it has also been found that the fabricated rectangular pallets receive significant wear when they are moved in and out of the mold box, and this limits the reusable life of each pallet. It has also been found desirable to provide for withdrawing each pallet from the mold box onto the run-out table or platform along a precise linear path. When the molded concrete article is precisely stripped from the mold box, damage to the molded concrete article is reduced, and scrap molded articles is minimized. The need for precision stripping of the molded article from the mold box cavity is particularly important when molding long rectangular concrete articles such as the concrete slabs or panels shown in the above patents since the articles are stripped longitudinally from the mold box.

SUMMARY OF THE INVENTION

The present invention is directed to an improved machine or apparatus for molding articles of concrete or other self-hardening moldable material and which provides for solving the problems outlined above in a relatively simple and effective manner. That is, the apparatus of the invention provides for pivotally supporting an elongated mold box with the mold box being generally balanced relative to a central pivot axis and without requiring the construction of a pit within the ground or floor. The apparatus also provides for precisely stripping a pallet-supported molded article from the mold box without damaging the molded article and while significantly reducing the wear on the supporting pallets as they are moved in and out of the mold box.

In general, the above features and advantages are provided by molding apparatus which incorporates an elongated mold box supported by a carriage for tilting or pivotal movement about a horizontal axis adjacent the center portion of the mold box. The carriage is supported for vertical movement by vertical guide posts or members, and fluid cylinders are connected to move the carriage and tilt the mold box between an upper vertical filling position and a lower horizontal stripping position.

The mold box also incorporates a tray member which supports each pallet within the mold box and is guided by rails within the mold box to aligned rails on a run-out platform in response to actuation of a fluid cylinder located within the mold box under the tray member and connected to the tray member.

Other features and advantages of the invention will be apparent from the following description, the accompanying drawings and the appended claims.

DESCRIPTION OF THE PREFERRED EMBODIMENT

Figure 1:
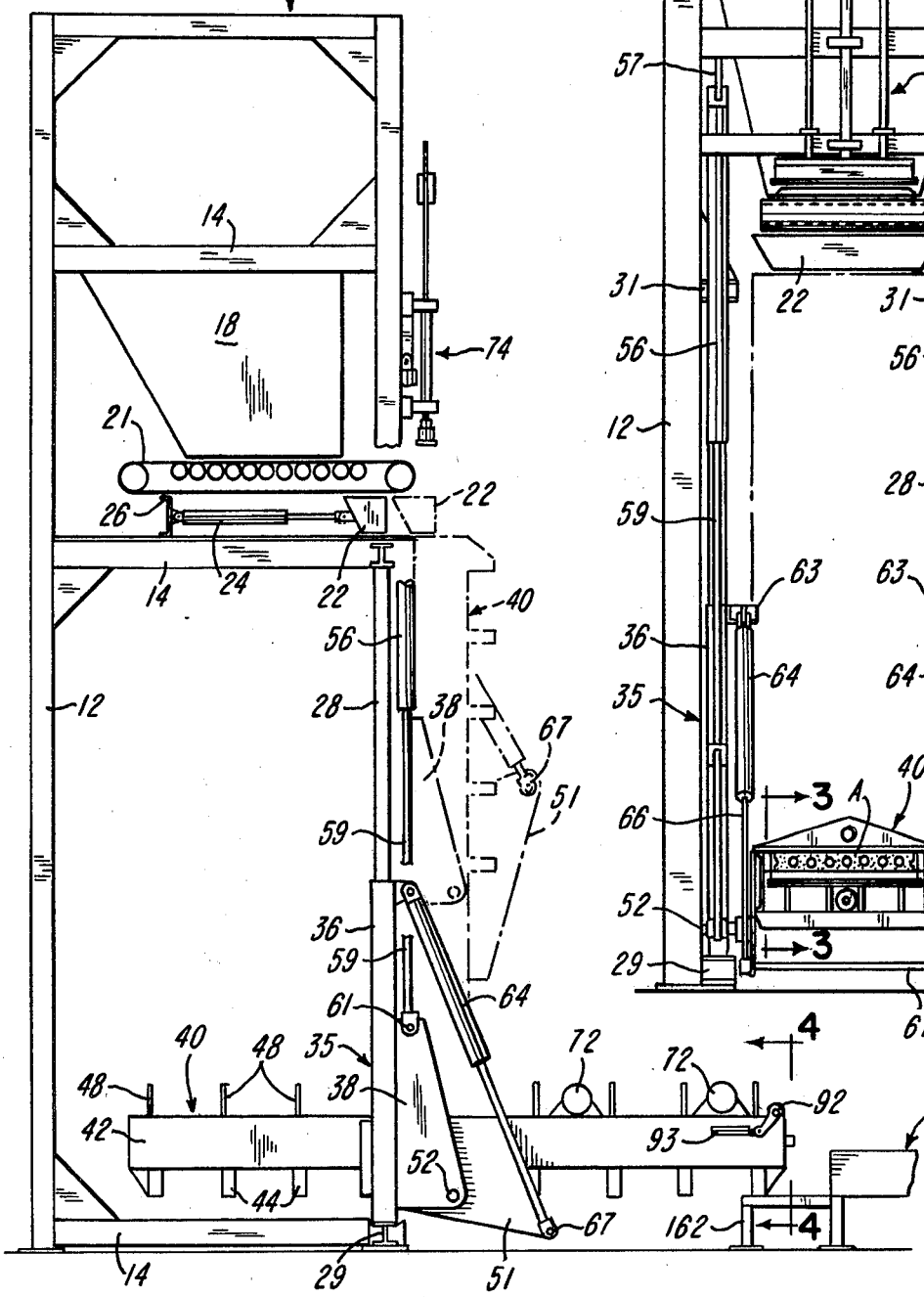
FIG. 1 is a side elevational view of molding apparatus constructed in accordance with the invention and with a portion of the frame broken away to show the support for the mold box.
Figure 2:
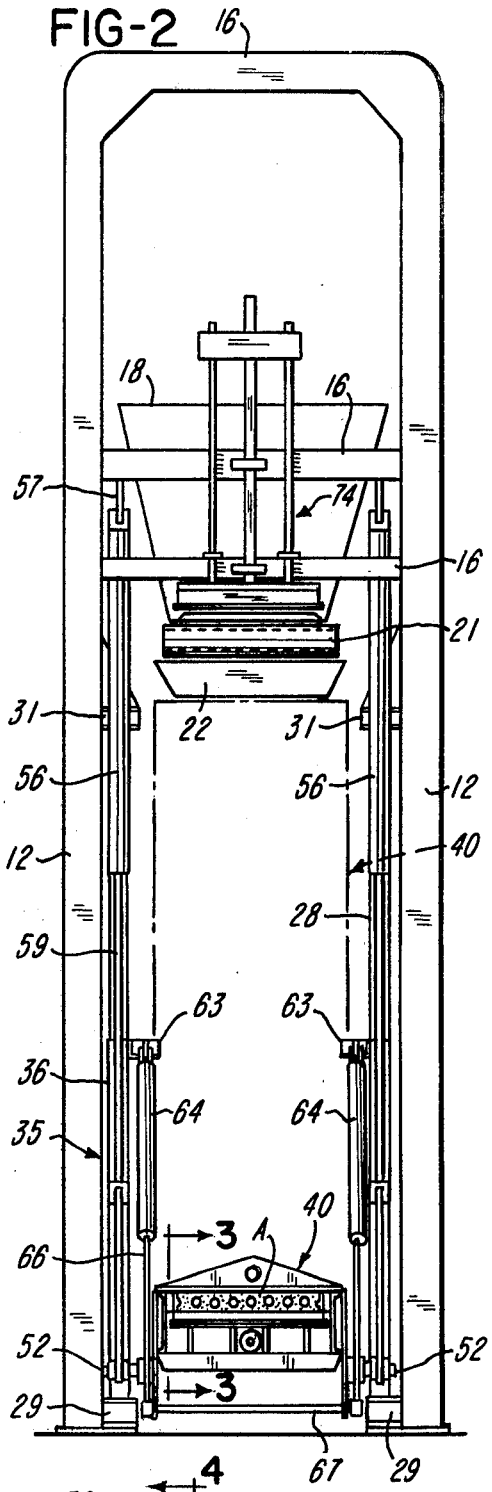
FIG. 2 is a front-elevational view of the apparatus shown in FIG. 1.

FIGS. 1 and 2 show a concrete molding apparatus constructed in accordance with the invention and which includes a fabricated steel frame 10 formed by four vertical corner posts or columns 12 rigidly connected by horizontal cross frame members 14 and 16. The upper portion of the frame 10 supports a hopper 18 which is adapted to receive from an inclined conveyor (not shown) a supply of fresh concrete of a predetermined volume, for example, two cubic yards. An endless belt conveyor 21 extends horizontally adjacent the bottom opening of the hopper 18 for delivering the concrete at a predetermined rate to a target hopper 22 which is supported by the frame members 14 for horizontal movement. A fluid or hydraulic cylinder 24 is supported by a cross frame member 26 and has a piston rod connected to the target hopper 22 for moving the target hopper between a retracted position as shown by the full lines in FIG. 1 and an extended position as shown by the dotted lines.

In accordance with the present invention, the frame 10 supports a pair of horizontally spaced vertical guide members or cylindrical posts 28 which extend between corresponding lower base pads 29 and upper frame brackets 31 projecting inwardly from the front corner posts 12 of the frame 10. The vertical guide posts 28 support a carriage 35 for vertical movement between a lower position as shown by the full lines in FIGS. 1 and 2 and an upper position as shown by the dotted lines in FIG. 1. The carriage 35 includes a pair of guide tubes 36 which are supported by the guide posts 28 for vertical sliding movement, and a pair of parallel steel side plates 38 are rigidly secured to the guide tubes 36.

Spaced between the side plates 38 and supported by the carriage 35 is an elongated mold box 40 having a pair of longitudinally extending side frame members or channels 42 which are rigidly connected by longitudinally spaced bottom cross tubes or frame members 44, a top rectangular plate 47 (FIG. 3) and longitudinally spaced top cross members or plates 48. A pair of vertical side plates 51 (FIGS. 1 and 2) are rigidly secured to the center portion of the mold box 40 and are located inwardly of the side plates 38 of the carriage 35. A pair of aligned stub shafts 52 from a pivot connection between the carriage side plates 38 and the mold box side plates 51 and provide for tilting the mold box 40 on the axis of the shafts 52 between a horizontal stripping position, as shown by the full lines in FIGS. 1 and 2, and a vertical filling position, as shown generally by the dotted lines in FIGS. 1 and 2.

A pair of vertical fluid or hydraulic cylinders 56 (FIGS. 1 and 2) have upper end portions connected by plates 57 to a cross frame member 16 of the frame 10, and the piston rods 59 of the cylinders 56 are connected by pins 61 to the side plates 38 of the carriage 35. The carriage 35 also includes a pair of inwardly projecting brackets 63 (FIG. 2) which are secured to the upper end portions of the slide tubes 36. The brackets 63 pivotally support another set of fluid or hydraulic cylinders 64 which have piston rods 66 connected by a cross shaft 67 to the side plates 51 of the mold box 40.

As apparent from FIGS. 1 and 2, when the hydraulic cylinders 56 are actuated to retract the piston rods 59, the carriage 35 and the mold box 40 are elevated, and when the hydraulic cylinders 64 are actuated to retract the piston rods 66, the mold box 40 is tilted or pivoted relative to the carriage 35. Thus by first actuating the hydraulic cylinders 56 to elevate the mold box 40 to a predetermined height, and then actuating the cylinders 64, the mold box 40 may be tilted to its vertical filling position while the mold box always remains above the ground or floor level.

When the mold box 40 is in its vertical filling position, fresh concrete is supplied to the mold box cavity through the target hopper 22 and while hydraulic drive vibrators 72 are actuated to assure that the mold box cavity is completely filled with concrete. After the mold box is filled with concrete, the target hopper 22 is retracted to remove any excess concrete from the top of the mold box. The end of the concrete article is tamped by lowering a tamper member into the mold box cavity with a hydraulic actuated tamper assembly 74 mounted on the frame 10. When it is desired to move the mold box 40 from its vertical position to its horizontal position, the cylinders 64 are first actuated to tilt the mold box 40 to a horizontal position while the carriage 35 remains elevated. The cylinders 56 are then actuated to lower the carriage 35 and the horizontal mold box 40 to its stripping position.

Figure 3:
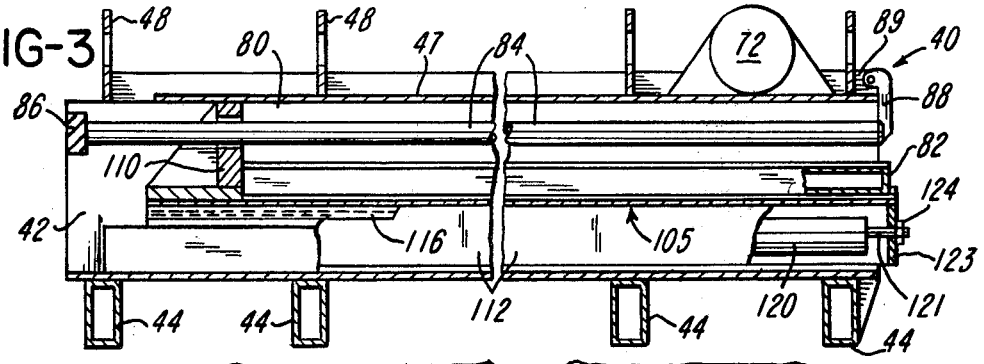
FIG. 3 is a longitudinal section of the mold box taken generally on the line 3—3 of FIG. 2 and with a center portion broken away.
Figure 4:
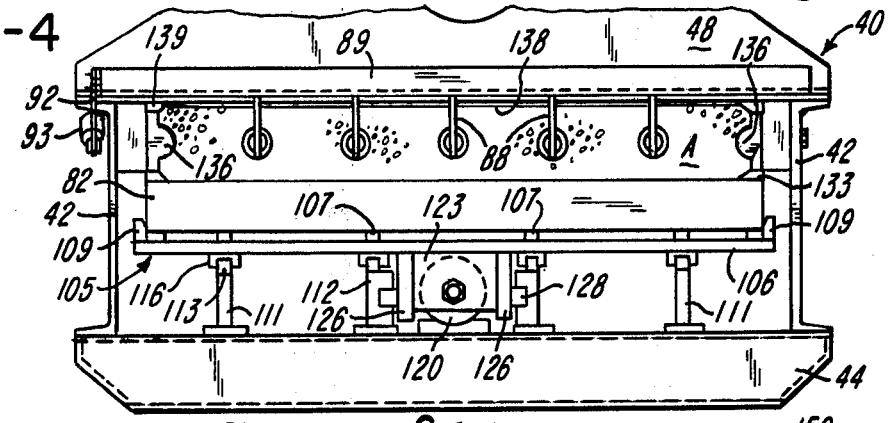
FIG. 4 is an end view of the mold box taken generally on the line 4—4 of FIG. 1.

Referring to FIGS. 3 and 4, the mold box 40 is constructed generally similar to the mold box disclosed in above-mentioned U.S. Pat. No. 4,068,996. That is, the mold box 40 defines a rectangular cavity 80 which receives a rectangular flat pallet 82 and a plurality of parallel spaced cylindrical core tubes 84. The core tubes 84 are supported on their inner ends by a cross member or bar 86 rigidly secured to the side frame members of channels 42 of the mold box 40. The opposite ends of the core tubes 84 are located within the open end of the cavity 80 and are supported during the filling operation by corresponding core support arms 88 mounted on a cross member 89 rotatably supported by the top plate 47 of the mold box 40. A lever 92 (FIG. 1) is secured to an outer end portion of a support shaft for the member 89 and is actuated by a fluid or hydraulic cylinder 93 for pivoting the core support arms 88 between their core supporting positions (FIG. 3) and horizontal retracted positions, as shown in above-mentined U.S. Pat. No. 4,068,996.

In accordance with the present invention, the rectangular flat pallet 82 is supported within the mold box 40 by a pallet support tray member 105 (FIG. 4) which includes a flat rectangular metal plate 106 which is slightly wider than the pallet 82. A plurality of longitudinally extending and laterally spaced replaceable wear strips 107 are secured to the plate 106 and form a planar surface for supporting the pallet 82. A pair of longitudinally extending opposite side strips 109 are also secured to the plate 106 and confine the pallet 82 from lateral movement. A stripper or push plate 110 is secured to the inner end portion of the plate 106 and has holes for receiving the core tubes 84. The stripper plate 110 forms the inner end surface for defining the mold cavity 80.

The pallet support tray 105 is supported within the mold box 40 for longitudinal sliding movement by a plurality of longitudinally extending and laterally spaced guide rails 111 and 112 each of which has a replaceable hardened wear strip 113 forming its top surface. The wear strips 113 are received within corresponding inverted guide channels 116 which are secured to the underneath surface of the plate 106 and form part of the pallet support tray 105.

As shown in FIGS. 3 and 4, an elongated fluid or hydraulic cylinder 120 extends longitudinally within the center of the mold box 40 and has a piston rod 121 which is connected to the support tray 105 by an end plate 123 and a nut 124. The plate 123 extends laterally between a pair of longitudinally extending guide members or rails 126 (FIG. 4) which are secured to the underneath surface of plate 106. A longitudinally extending key 128 is secured to each of the guide rails 126 and is received within a corresponding channel-like guide track recessed within the adjacent guide track 112. This support system for the pallet support tray member 105 assures that the pallet 82 and its supporting tray member 105 move in a precise linear path when the hydraulic cylinder 120 is actuated.

As mentioned above, after the mold box 40 is tilted to its vertical filling position, uncured concrete is supplied to the cavity 80 around the core tubes 84. Preferably, the pallet 82 has longitudinally extending chamber forming edge strips 133 which slide into the mold box below corresponding edge form members 136 which are secured to the side channels 42 of the mold box. The edge form members 136 also support a top mold plate 138 which carry chamfer forming edge strips 139. When the mold box cavity 80 is filled with concrete, the concrete fills the space between the pallet 82 and the mold plate 138 and between the edge form members 136 around the core tube 84 to form a rectangular slab or panel or article A (FIG. 6) having longitudinally extending core holes 142 and beveled corner surfaces 143.

After the mold box cavity is filled to form the concrete article A and the mold box 40 is tilted to its horizontal stripping position (FIG. 1), the core tube support arms 88 are retracted upwardly. The hydraulic cylinder 120 is then actuated to extend the piston rod 121 so that the pallet support tray 105 and pusher plate 110 eject the pallet 82 and strip the molded article A from the core tubes 84. As the article is stripped, the upper mold plate 138 remains with the molded article, as shown in FIG. 6.

Figure 5:
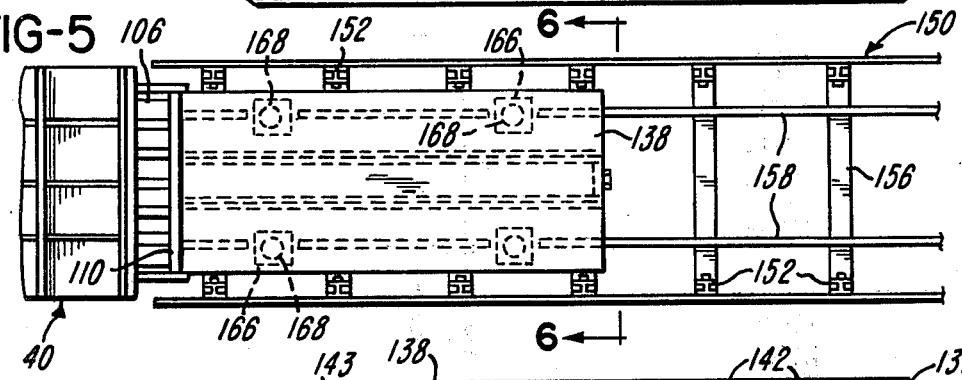
FIG. 5 is a plan view illustrating the stripping of a molded concrete article from the mold box onto the run-out platform.
Figure 6:
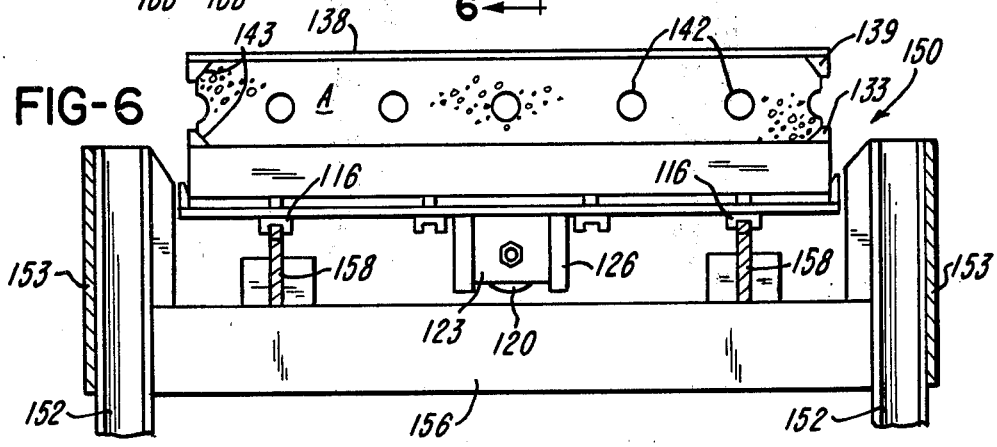
FIG. 6 is a section of the run-out platform as taken generally on the line 6—6 of FIG. 5.

As the pallet support tray member 105 is extended from the mold box 40, the tray member 105 is received by a run-out table or platform 150 (FIGS. 1, 5 and 6). The run-out platform 150 includes a plurality of vertical support legs 152 which are rigidly connected by longitudinally extending side plates 153 and longitudinally spaced cross members 156. The cross members 156 support a pair of longitudinally extending guide rails 158 which align with the guide rails 111 within the mold box 40 when the mold box is located in its horizontal stripping position. The rails 158 receive the corresponding guide channels 116 on the bottom of the pallet support tray member 105 and serve as an extension of the guide rails 111 to assure precision linear movement of the support tray 105, pallet 82 and molded article A onto the run-out platform 150. As shown in FIG. 1, the platform 150 includes a lower extension 162 which forms a support for the filling end portion of the mold box 42 when the mold box is pivoted to its horizontal stripping position to assure that the guide rails 111 align precisely with the guide rails 158.

Referring to FIG. 5, the pallet support tray member 105 is provided with a set of four rectangular openings 166 which align with corresponding vertical fluid or hydraulic cylinders 168 located within the run-out platform 150 below the path of the tray member. When the cylinders 168 are actuated after a molded concrete article A is stripped from the mold box 40 onto the run-out platform 150, the support pallet 82 is elevated above the side plates 153 of the platform 150 along with the article A and the upper mold plate 138. In this elevated position, a pallet supported molded concrete article A may be conveniently received by a fork lift truck for transporting the pallet supported article to a curing rack. It is also understood that each pallet supported article may be transferred from the run-out table or platform 150 by other means such as, for example, by a horizontal conveyor system.

Figure 7:
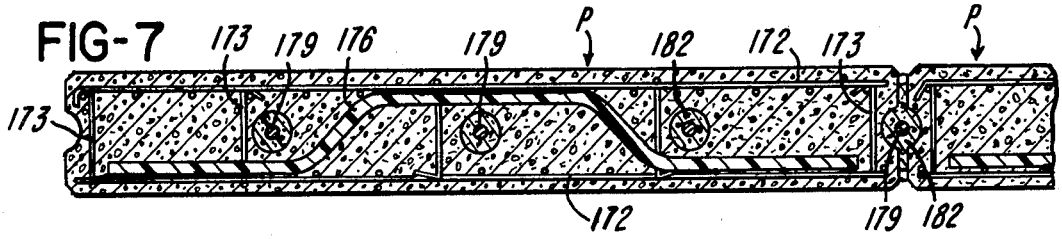
FIG. 7 is a horizontal cross-section of a molded concrete wall panel produced on the apparatus shown in FIGS. 1-6 and illustrating the assembly of the wall panel with an adjoining wall panel for a building.

FIG. 7 illustrates a typical reinforced concrete panel P which can be effectively produced with the apparatus described above in connection with FIGS. 1–6. The panel P may be used in forming a wall, floor or roof of a building and includes parallel spaced steel reinforcing mats 172 which are rigidly interconnected by steel cross or tie rods 173. The concrete panel P also includes a thermal insulation panel 176 of expanded plastics foam material and which is confined between the steel reinforcing mats 172 with a center portion of the insulation panel adjacent one of the mats 172 and the opposite edge portions adjacent the other mat, providing the insulation panel 176 with a hat-shaped cross-sectional configuration.

The steel reinforcing tie rods 173 extend through the foam insulation panel 176 and serve to position the insulation panel when the steel reinforcing is inserted into the mold box cavity 80 prior to filling the cavity with concrete. The erected concrete panel P shown in FIG. 7 is also provided with steel reinforcing rods 179 which extend within the core holes 142 and within the cavities defined between the opposing edge surfaces of the adjacent panels. A cement grout material 182 is poured within the core holes and cavities around the reinforcing rods 179 to form a bond between the reinforcing rods 179 and the concrete forming the panels P.

From the drawings and the above description, it is apparent that molding apparatus constructed in accordance with the present invention provides desirable features and advantages. For example, the support of the mold box 40 for pivotal or tilting movement by the vertically movable carriage 35 enables the mold box to be generally balanced with respect to its pivot axis and to be tilted or pivoted between its filling and stripping positions without requiring the construction of a pit within the ground or floor. Thus the apparatus provides for using a relatively long mold box 40, for example, of about eighteen or twenty feet, and the molding apparatus may be more easily transported and erected at different sites, if desired. The balanced support of the mold box 40 also minimizes the power required from the cylinders 64 for tilting the mold box between its filling and stripping positions and further minimizes the stresses and distortion within the mold box.

As also mentioned above, the use of the support tray member 105 and the guide rails 111, 112 and 158 for supporting the pallet supported article A, also provides important advantages. That is, this support and guide system assures precise stripping of each molded concrete article from the mold box and thus minimizes any damage to the molded article during the stripping operation. The support tray system also minimizes wear on the pallets and thus provides each pallet with a longer useful life. The support tray member 105 also provides a protection for the hydraulic stripping cylinder 120, and the guide rails cooperate to maintain axial alignment of the piston rod 121 when it is extended from the cylinder 120. The construction of the concrete panel P shown in FIG. 7 also provides a high strength panel with thermal insulation.

While the form of molding apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. In apparatus for molding articles of self-hardening moldable material and including a mold box defining a molding cavity, means supporting said mold box for tilting movement between a generally vertical filling position and a generally horizontal stripping position, means for supplying the moldable material to said mold box when in said filling position to form a molded article within said mold box, means for receiving a molded article from said cavity after said mold box is moved to said stripping position, and means for stripping the molded article from said mold box, the improvement wherein said means supporting said mold box comprise a movable carriage having pivot means supporting an intermediate portion of said mold box for tilting movement, linear guide means supporting said carriage for generally vertical movement, power actuating means for tilting said mold box relative to said carriage, and power actuated means for moving said carriage vertically before said mold box is tilted completely to said filling position.

2. Apparatus as defined in claim 1 wherein said power actuated means for tilting said mold box comprise at least one fluid cylinder, and pivot means connecting said fluid cylinder to said carriage and to said mold box.

3. Apparatus as defined in claim 2 wherein said pivot means connecting said fluid cylinder to said mold box has a pivot axis below a pivot axis for said mold box when said mold box is in said stripping position.

4. Apparatus as defined in claim 1 wherein said means supporting said carriage for generally vertical movement comprise a plurality of horizontally spaced generally vertical guide members, and said carriage includes means mounted on said guide members for said generally vertical movement.

5. Apparatus as defined in claim 4 wherein said guide members are cylindrical, and said means on said guide members comprise cylindrical tubes mounted on said guide members for sliding movement.

6. Apparatus as defined in claim 1 wherein said means supporting said mold box for tilting movement comprise a pair of side plates mounted on said carriage with said mold box spaced between said side plates, and said pivot means connect said side plates to said mold box.

7. Apparatus as defined in claim 1 wherein said power actuated means for moving said carriage comprise at least one fluid cylinder disposed above said mold box and having a generally vertical axis.

8. Apparatus as defined in claim 1 wherein said power actuated means for moving said carriage is separate from said power actuated means for tilting said mold box, and said power actuated means are independently controllable for moving said carriage upwardly prior to tilting said mold box relative to said carriage.

9. Apparatus as defined in claim 1 and including a generally flat pallet adapted to be received within said mold box, a generally flat tray member disposed within said mold box and supporting said pallet, means for guiding said tray member in a linear direction between a retracted position within said mold box and an extended position at least partially removed from said mold box, and power actuated means for moving said tray member between said retracted and extended positions for precisely stripping a molded article from said mold box while the article is being supported by said pallet.

10. Apparatus as defined in claim 9 wherein said tray member comprises a support plate, said guiding means comprise a set of parallel spaced guide rails within said mold box, and said means for receiving a molded article comprise a set of generally horizontal parallel spaced guide rails aligned with said guide rails within said mold box when said mold box is in said stripping position.

11. Apparatus as defined in claim 10 and including a plurality of parallel spaced guide channels projecting downwardly from said support plate and supported by said guide rails for sliding movement, and a pair of edge rails projecting upwardly from said support plate for confining said pallet therebetween.

12. Apparatus as defined in claim 10 and including a plurality of parallel spaced wear strips projecting upwardly from said support plate for engaging said pallet.

13. Apparatus as defined in claim 9 and including means defining a plurality of holes within said tray member to provide for elevating said pallet and the supported article from said tray member after being stripped from said mold box by said tray member.

14. Apparatus as defined in claim 9 wherein said power actuated means for moving said tray member comprise an elongated fluid cylinder disposed within said mold box, and means connecting said cylinder to said tray member.

15. Apparatus as defined in claim 9 wherein said means for receiving a molded article from said mold box comprise an elongated platform having a plurality of longitudinally extending parallel spaced guide rails for receiving said tray member, and said mold box including a plurality of parallel spaced guide rails supporting said tray member for sliding linear movement.

16. In apparatus for molding articles of self-hardening moldable material and including a mold box defining a molding cavity, means supporting said mold box for tilting movement between a generally vertical filling position and a generally horizontal stripping position, means for supplying the moldable material to said mold box when in said filling position to form a molded article within said mold box, a pallet disposed within said mold box, a run-out platform for receiving said pallet and a molded article from said cavity after said mold box is moved to said stripping position, power actuated means for moving said mold box between said filling and stripping positions, and power actuated means for stripping said pallet and the molded article from said mold box, the improvement wherein said mold box includes a generally flat tray member supporting substantially all of said pallet, guide means supporting said tray member for linear movement from a retracted position within said mold box to an extended position projecting from said mold box, and said platform has guide means for maintaining the linear movement of said tray member.

17. Apparatus as defined in claim 16 wherein said tray member comprises a support plate, said guide means comprise a set of parallel spaced guide rails within said mold box, and said guide means on said platform comprise a set of generally horizontal parallel spaced guide rails aligned with said guide rails within said mold box when said mold box is in said stripping position.

18. Apparatus as defined in claim 17 and including a plurality of parallel spaced guide channels projecting downwardly from said support plate and supported by said guide rails for sliding movement, and a pair of edge rails projecting upwardly from said support plate for confining said pallet therebetween.

19. Apparatus as defined in claim 17 and including a plurality of parallel spaced wear strips projecting upwardly from said support plate for engaging said pallet.

20. Apparatus as defined in claim 16 and including means defining a plurality of holes within said tray member to provide for elevating said pallet and the supported article from said tray member after being stripped from said mold box by said tray member.

21. Apparatus as defined in claim 16 wherein said power actuated means for stripping said pallet and the molded article comprise an elongated fluid cylinder disposed within said mold box, and means connecting said cylinder to said tray member.

* * * * *